US008142146B2

(12) United States Patent
Kawakami

(10) Patent No.: US 8,142,146 B2
(45) Date of Patent: Mar. 27, 2012

(54) STEAM TURBINE

(75) Inventor: Hiroshi Kawakami, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 750 days.

(21) Appl. No.: 12/195,897

(22) Filed: Aug. 21, 2008

(65) Prior Publication Data

US 2009/0068001 A1 Mar. 12, 2009

(30) Foreign Application Priority Data

Aug. 22, 2007 (JP) ..... 2007-215769

(51) Int. Cl.
*F03B 11/02* (2006.01)

(52) U.S. Cl. ..... 415/202; 415/203; 415/209.2

(58) Field of Classification Search ..... 415/202, 415/203, 209.2

See application file for complete search history.

(56) References Cited

U.S. PATENT DOCUMENTS

| | | | | |
|---|---|---|---|---|
| 3,746,463 | A | 7/1973 | Stock et al. | |
| 4,362,464 | A | 12/1982 | Stock | |
| 4,498,301 | A * | 2/1985 | Tsubouchi | 60/657 |
| 4,550,569 | A * | 11/1985 | Isa et al. | 60/657 |
| 4,884,934 | A * | 12/1989 | Ikeda et al. | 411/383 |
| 5,215,436 | A * | 6/1993 | Puzyrewski | 415/202 |
| 5,392,513 | A * | 2/1995 | Mazzola et al. | 29/889.1 |
| 5,411,365 | A * | 5/1995 | Mazzola et al. | 415/93 |
| 6,341,937 | B1 | 1/2002 | Magoshi et al. | |
| 2009/0053048 | A1* | 2/2009 | Kawakami et al. | 415/173.1 |
| 2009/0068001 | A1* | 3/2009 | Kawakami | 415/193 |

FOREIGN PATENT DOCUMENTS

| | | | |
|---|---|---|---|
| DE | 846 696 | C | 8/1952 |
| DE | 759 486 | C | 3/1953 |
| DE | 10 04 202 | B | 3/1957 |
| EP | 1 094 201 | A1 | 4/2001 |
| EP | 1 096 110 | A1 | 5/2001 |
| EP | 1 098 070 | A1 | 5/2001 |
| GB | 790 654 | A | 2/1958 |
| GB | 1 010 300 | A | 11/1965 |
| GB | 1 073 415 | A | 6/1967 |
| JP | 51-065102 | U | 5/1976 |
| JP | 56-109602 | U | 8/1981 |

(Continued)

OTHER PUBLICATIONS

U.S. Appl. No. 12/195,905, filed Aug. 21, 2008, Kawakami et al.

(Continued)

*Primary Examiner* — George Fourson, III
(74) *Attorney, Agent, or Firm* — Foley & Lardner LLP

(57) ABSTRACT

A steam turbine has a stationary section, a turbine rotor, nozzle diaphragms, and a nozzle box. The stationary section includes a casing. The turbine rotor includes moving blade stages arranged in an axial direction. Each of the moving blade stages is provided with moving blades arranged in a circumferential direction, and rotatably provided in the casing. Each of the nozzle diaphragms has turbine nozzles arranged in the circumferential direction provided substantially coaxially with the turbine rotor by being secured to the stationary section. The nozzle box is supported on the stationary section and arranged at an upstream part of the moving blade stages substantially coaxially with the turbine rotor so as to lead steam flowing toward the turbine moving blades. The nozzle box holds at least two stages of the nozzle diaphragms.

2 Claims, 5 Drawing Sheets

FOREIGN PATENT DOCUMENTS

| | | | |
|---|---|---|---|
| JP | 59-206602 | A | 11/1984 |
| JP | 61-085502 | A | 5/1986 |
| JP | 61-138804 | A | 6/1986 |
| JP | 3-066484 | B2 | 10/1991 |
| JP | 2006-104951 | A | 4/2006 |
| JP | 2008-075645 | A | 4/2008 |

OTHER PUBLICATIONS

H. Kawakami, U.S. PTO Office Action, U.S. Appl. No. 12/195,905, dated Jul. 27, 2011, 16 pages.

H. Kawakami, U.S. PTO Notice of Allowance, U.S. Appl. No. 12/195,905, dated Dec. 9, 2011, 8 pages.

* cited by examiner

STEAM TURBINE

CROSS REFERENCES TO RELATED APPLICATIONS

This application is based upon and claims the benefit of priority from the prior Japanese Patent Application No. 2007-215769, filed in the Japanese Patent Office on Aug. 22, 2007, the entire content of which is incorporated herein by reference.

BACKGROUND OF THE INVENTION

The present invention relates to a steam turbine and, more particularly, it relates to steam turbine designed to achieve a high efficiency by improving the nozzle box arrangement in the steam inlet section.

Generally, a steam turbine comprises a rotatable turbine rotor, moving blade stages, a casing and nozzle diaphragms. The casing and the nozzle diaphragms constitute as a stationary section. The rotor is rotatably provided in the casing. The nozzle diaphragms are arranged substantially coaxially with the turbine rotor, supported on the casing. The moving blade stages are provided on the turbine rotor so as to rotate together with the turbine rotor. Each of the moving blade stages comprises a plurality of moving blades arranged in the circumferential direction of the turbine rotor.

Each of the nozzle diaphragms comprises a plurality of turbine nozzles arranged in the circumferential direction relative to the turbine rotor and arranged at the upstream side of one of the moving blade stage. A pair of a nozzle diaphragm and a moving blade stage provided at the upstream side of the nozzle diaphragm forms a turbine stage. An ordinary steam turbine has a plurality of turbine stages.

More specifically, nozzle diaphragms, a turbine rotor and moving blade stages are substantially coaxially arranged in the casing. The steam led to a nozzle diaphragm passes through a plurality of turbine nozzles of the nozzle diaphragm and change its flowing direction. Then, the steam flowing out from the nozzle diaphragm is led to a moving blade portion of a moving blade stage that forms a pair with the nozzle diaphragm. The steam drives the moving blade stage and the turbine rotor as it passes between the plurality of moving blades of the moving blade stage.

As pointed out above, an ordinary steam turbine has a plurality of turbine stages. The steam that passes through one turbine stage is led to an adjacent turbine stage. More specifically, a plurality of moving blade stages are provided on the turbine rotor, separated from each other in the axial direction. The nozzle diaphragms are arranged in the casing so as to be placed between the moving blade stages in the axial direction of the turbine rotor. The moving blade portions of a plurality of moving blade stages and the turbine nozzle portions of a plurality of nozzle diaphragms form a steam passage.

Especially, for a high pressure turbine, a nozzle box is provided in the casing to lead the steam introduced in the casing to the turbine nozzles of the first stage, which constitute as a part of the steam passage. Known nozzle boxes include one described in Japanese Patent Application Laid-Open Publication No. 03-066484, the entire content of which is incorporated herein by reference.

Like the casing, the nozzle box constitutes as the stationary section. The nozzle box comprises a plurality of turbine nozzles of the first stage, which are arranged in the circumferential direction, provided at the outlet side of the nozzle box. In other words, the nozzle box and the nozzle diaphragm of the first stage (e.g. the first stage nozzle diaphragm) are arranged integrally and the steam introduced into the nozzle box is led to the steam passage, that includes the first moving blade stage that forms a pair with the first stage nozzle diaphragm provided with the nozzle box.

FIGS. 5 and 6 are schematic axial cross-sectional views of a known steam turbine having a nozzle box. FIG. 5 is a schematic axial cross-sectional view along a vertical direction and FIG. 6 is a schematic axial cross-sectional view along an angle inclined relative to the vertical direction by 45°.

The steam turbine 1 has a casing 2, a turbine rotor 3 rotatably arranged in the casing 2, a nozzle diaphragms 4*a*1, 4*a*2, 4*a*3, . . . that are rigidly secured to the casing 2. The casing 2 includes an outer casing 2*a* and an inner casing 2*b*.

A plurality of moving blade stages 3*a*1, 3*a*2, 3*a*3, . . . are arranged on the turbine rotor 3, which is a rotating section of the steam turbine 1, in the axial direction from the upstream side to the downstream side. Each of the moving blade stages 3*a*1, 3*a*2, 3*a*3 has a plurality of moving blades, the plurality of moving blades of the moving blade stages being denoted respectively by 3*b*1, 3*b*2, 3*b*3, . . . , and rotating force is generated as steam flows, passing through between the rotors 3*b*1, 3*b*2, 3*b*3, . . . .

Nozzle diaphragms 4*a*1, 4*a*2, 4*a*3, . . . that are supported by the inner casing 2*b* are arranged between the moving blade stages 3*a*1, 3*a*2, 3*a*3, . . . such that they are substantially coaxial and separated from each other in the axial direction. A pair of the nozzle diaphragms 4*a*1, 4*a*2, 4*a*3, . . . and the moving blade stages 3*a*1, 3*a*2, 3*a*3, . . . , respectively, constitutes a turbine stage. A plurality of turbine nozzles 4*b*1, 4*b*2, 4*b*3, . . . are provided in the circumferential direction, respectively, with the nozzle diaphragms 4*a*1, 4*a*2, 4*a*3, . . . .

The nozzle diaphragms 4*a*1, 4*a*2, 4*a*3, . . . are supported by the casing 2 so as to constitute a stationary section of the steam turbine 1. The steam flow flowing through between the plurality of nozzle blades 4*b*1, 4*b*2, 4*b*3 arranged in the circumferential direction is changed its flowing direction so as to be led to the moving blades 3*b*1, 3*b*2, 3*b*3, . . . of the moving blade stages 3*a*1, 3*a*2, 3*a*3, . . . of the pairs. The flow path of the steam including the portions of the turbine nozzles 4*b*1, 4*b*2, 4*b*3, . . . of the nozzle diaphragms 4*a*1, 4*a*2, 4*a*3, . . . and the portions of the moving blades 3*b*1, 3*b*2, 3*b*3, . . . of the moving blade stages 3*a*1, 3*a*2, 3*a*3 constitute as steam passage 8. The steam led to the steam turbine 1 flows through the steam passage 8 from an upstream side to a downstream side.

The steam turbine 1 is provided with a steam inlet pipe 7 and a nozzle box 5 that constitutes as members for introducing steam into the steam passage 8. The nozzle box 5 is a pressure vessel that deals with high temperature and high pressure steam. An inlet section of the nozzle box 5 is connected to the steam inlet pipe 7. A steam outlet section, namely, outlet section, of the nozzle box 5 is integrally provided with the first stage nozzle diaphragm 4*a*1 and the plurality of turbine nozzles 4*b*1 that are arranged in the circumferential direction.

The nozzle box 5 is rigidly secured to the casing 2 by a support member 6 arranged on the inner casing 2*b*. The plurality of first stage turbine nozzles 4*b*1, integrally arranged in the circumferential direction at the outlet section, serves as the first stage nozzle diaphragm 4*a*1. The nozzle box 5 is arranged substantially coaxial with the turbine rotor 3.

Thus, the steam led into the nozzle box 5 from the steam inflow pipe 7 is then led to the first stage nozzle diaphragm 4*a*1 that operates as steam passage 8. The steam led to the steam passage 8 expands as it passes between the turbine nozzles 4*b*1, 4*b*2, 4*b*3, . . . and the moving blades 3*b*1, 3*b*2,

3*b*3, . . . and the thermal energy it has is converted into kinetic energy to drive the moving blade stages 3*a*1, 3*a*2, 3*a*3, . . . and the turbine rotor 3 to rotate.

Note that the support member 6 is a member for supporting the nozzle box 5 in the inner casing . The support member 6 is not arranged entirely along the nozzle box 5 in the circumferential direction as seen in FIG. 6.

Therefore, the pressure of the space around the nozzle box 5 (e.g. a space between the inner casing 2*b*and the turbine rotor 3) is substantially equal to the pressure of the steam passage 8 near the outlet of the first moving blade stage 3*a*1.

The steam conditions such as the temperature and the pressure of steam flowing into the steam turbine 1 are raised, the pressure of the steam flowing out from the first moving blade stage 3*a*1 is raised, and then the pressure in a space between the inner casing 2*b* and the turbine rotor 3 is also raised. Thus, the pressure applied to the internal casing 2*b* of the casing 2 is increased when applying the high pressure and high temperature steam to the steam turbine 1.

Therefore, when the pressure of the steam supplied to the steam turbine 1 is specifically raised, particularly the inner casing 2*b* of the casing 2 has to structurally withstand the force applied with the pressure. Expensive material such as Ni alloy may have to be used as the material of the inner casing 2*b* in consideration of the thermal resistance of the steam turbine 1 when the temperature is raised among the steam conditions. These would result in higher manufacturing cost.

BRIEF SUMMARY OF THE INVENTION

An object of the present invention is to provide a steam turbine that can reduce force applied to the casing 2.

According to the present invention, there is provided a steam turbine comprising: a stationary section that includes a casing; a turbine rotor that includes a plurality of moving blade stages arranged in an axial direction, each of the moving blade stages being provided with a plurality of moving blades arranged in a circumferential direction, and rotatably provided in the casing; a plurality of nozzle diaphragms, wherein each of the nozzle diaphragms having a plurality of turbine nozzles arranged in the circumferential direction, provided substantially coaxially with the turbine rotor by being secured to the stationary section; and a nozzle box supported on the stationary section, wherein the nozzle box is arranged at an upstream side of the moving blade stages substantially coaxially with the turbine rotor so as to lead steam flowing toward the turbine moving blades, wherein the nozzle box holds at least two stages of the nozzle diaphragms.

BRIEF DESCRIPTION OF THE DRAWINGS

The above and other features and advantages of the present invention will become apparent from the discussion hereinbelow of specific, illustrative embodiments thereof presented in conjunction with the accompanying drawings, in which.

DETAILED DESCRIPTION OF THE PREFERRED EMBODIMENTS

Now, the present invention will be described in greater detail by referring to the accompanying drawings that illustrate preferred embodiments of the invention.

Figure 1:
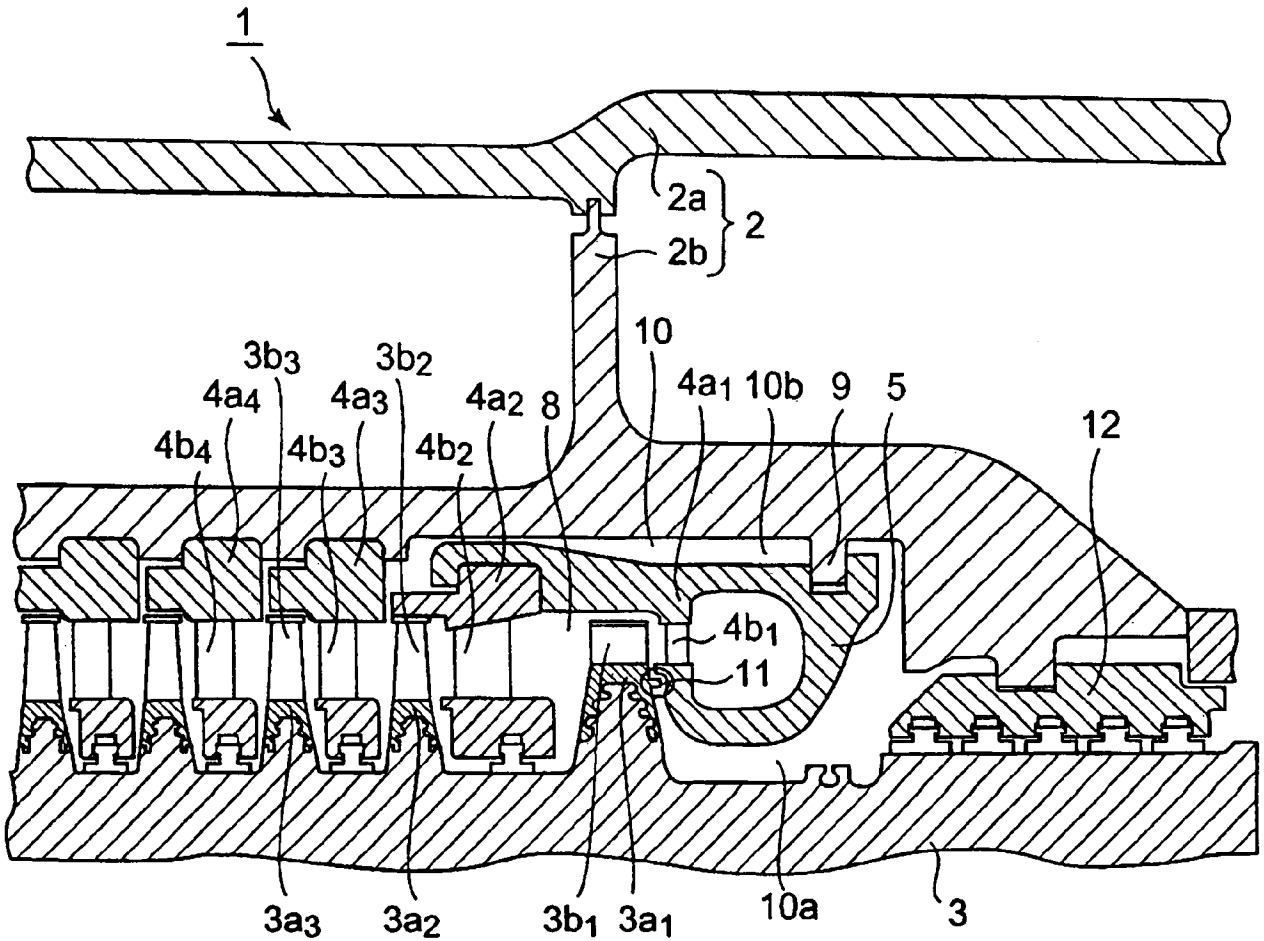
FIG. 1 is a schematic axial cross-sectional view of the first embodiment of steam turbine according to the present invention taken along a plane inclined by 45° from the vertical direction.
Figure 5:
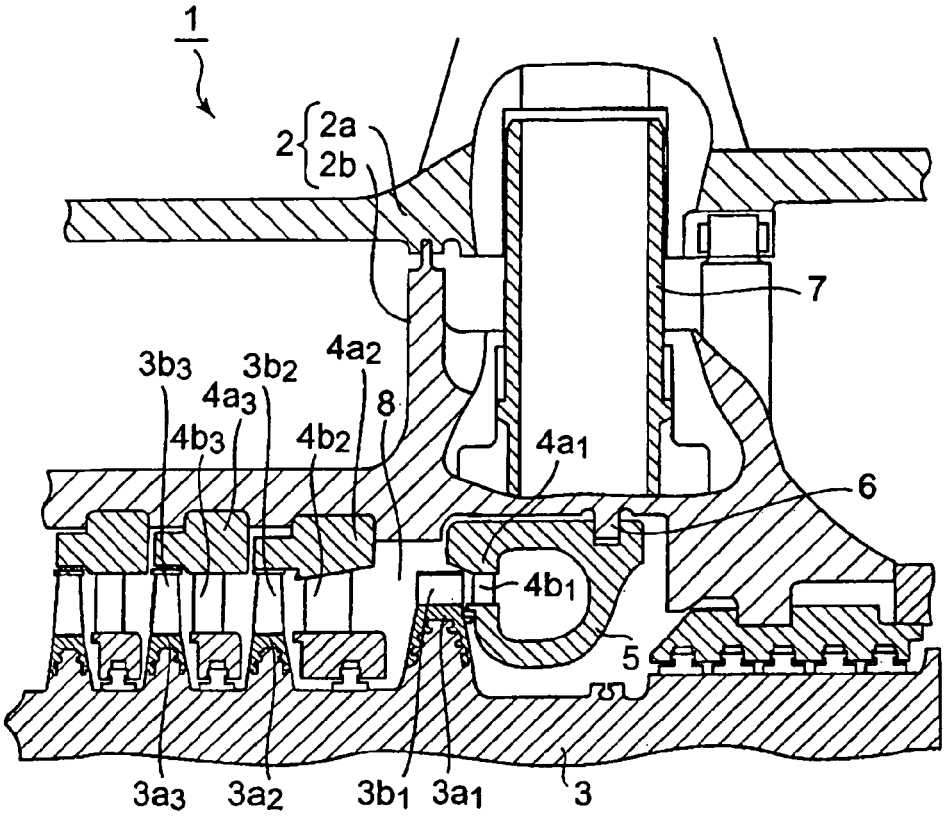
FIG. 5 PRIOR ART
FIG. 5 is a vertical schematic axial cross-sectional view of a known steam turbine along a vertical direction.
Figure 6:
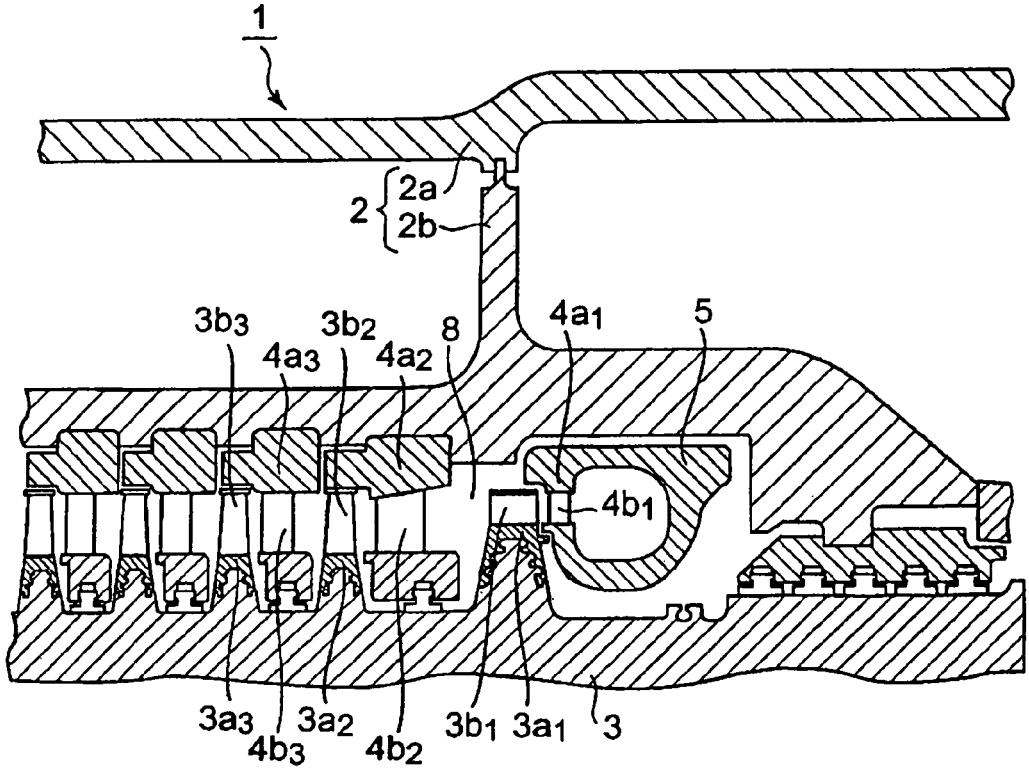
FIG. 6 PRIOR ART
FIG. 6 is a schematic axial cross-sectional view of the known steam turbine of FIG. 5 along a direction inclined by 45° as to a vertical direction.

FIG. 1 is a schematic axial cross-sectional view of the first embodiment of steam turbine according to the present invention taken along a plane inclined by 45° from the vertical direction. In FIG. 1, the components same as those of the known steam turbine shown in FIGS. 5 and 6 are denoted respectively by the same reference symbols and will not be described any further unless necessary.

The steam turbine 1 of this embodiment has a casing 2, a turbine rotor 3 rotatably arranged in the casing 2 and nozzle diaphragms 4*a*1, 4*a*2, 4*a*3, . . . rigidly secured to the casing 2. The casing 2 includes an outer casing 2*a* and an inner casing 2*b*.

A plurality of moving blade stages 3*a*1, 3*a*2, 3*a*3, . . . are arranged on the turbine rotor 3, which is a rotating section of the steam turbine 1, in the axial direction from the upstream side to the downstream side. Each of the moving blade stages 3*a*1, 3*a*2, 3*a*3 has a plurality of moving blades, the plurality of moving blades of the moving blade stages being denoted respectively by 3*b*1, 3*b*2, 3*b*3, . . . , and rotating force is generated as steam flows, passing between the rotors 3*b*1, 3*b*2, 3*b*3, . . . .

Nozzle diaphragms 4*a*1, 4*a*2, 4*a*3, . . . that are supported by the inner casing 2*b* are arranged between the moving blade stages 3*a*1, 3*a*2, 3*a*3, . . . such that they are substantially coaxial with the turbine rotor 3 and separated from each other in the axial direction. A pair of the nozzle diaphragms 4*a*1, 4*a*2, 4*a*3, . . . and the moving blade stages 3*a*1, 3*a*2, 3*a*3, . . . , arranged adjacent to at a downstream side of the nozzle diaphragms respectively, constitute a turbine stages. A plurality of turbine nozzles 4*b*1, 4*b*2, 4*b*3, . . . are provided in the circumferential direction, respectively with the nozzle diaphragms 4*a*1, 4*a*2, 4*a*3, . . . .

The nozzle diaphragms 4*a*1, 4*a*2, 4*a*3, . . . are supported by the casing 2 so as to constitute a stationary section of the steam turbine 1. The steam flow flowing through between the plurality of turbine nozzles 4*b*1, 4*b*2, 4*b*3, . . . , arranged in the circumferential direction, is changed its direction so as to be led to the moving blades 3*b*1, 3*b*2, 3*b*3, . . . of the adjacently arranged moving blade stages 3*a*1, 3*a*2, 3*a*3, . . . of the pairs. The flow path of the steam including the portions of the turbine nozzles 4*b*1, 4*b*2, 4*b*3, . . . of the nozzle diaphragms 4*a*1, 4*a*2, 4*a*3, . . . and the portions of the moving blades 3*b*1, 3*b*2, 3*b*3, . . . of the moving blade stages 3*a*1, 3*a*2, 3*a*3 constitute as a steam passage 8. The steam led to the steam turbine 1 flows through the steam passage 8 from an upstream side to a downstream side.

A shaft sealing device 12 is provided between the turbine rotor 3 and the inner casing 2*b* to seal the shaft so as to prevent steam in the vicinity of the turbine rotor 3 from leaking to the space outside the inner casing 2*b*. The shaft sealing device 12 comprises a main body and a plurality of packing heads that circumferentially engage with the main body.

An anti-leakage steam seal 11 is arranged between the first stage nozzle diaphragm 4*a*1 and the first moving blade stage 3*a*1. The anti-leakage steam seal 11 reduces the flow of steam leaking from the steam passage 8 between the first stage nozzle diaphragm 4*a*1 and the adjacently arranged moving blade stage 3*a*1.

The steam turbine 1 is provided with a nozzle box 5 that introduces steam into the steam passage 8. The nozzle box 5 is secured to the inner casing 2*b* in the space 10 between the turbine rotor 3 and the inner casing 2*b*, substantially coaxial with the turbine rotor 3. The nozzle box 5 constitutes as a stationary section of the steam turbine 1.

The nozzle box 5 is a pressure vessel that deals with high temperature and high pressure steam. Like the known steam turbine shown in FIG. 5, a steam inlet pipe (not shown) is connected to the steam inlet section of the nozzle box 5.

At the outlet section of the nozzle box 5, namely a steam outlet section of the nozzle box 5, constitutes as part of the steam passage 8, a plurality of first stage turbine nozzles 4*b*1 are arranged in the circumferential direction. In other words, the first stage nozzle diaphragm 4*a*1 is structurally integrally provided at the outlet section of the nozzle box 5.

The outer peripheral side member of the nozzle box 5 extends to the downstream side in the axial direction. A hook section is provided in the axial direction at the downstream side of the extended outer peripheral side member of the nozzle box 5. The hook section is engaged with the second stage nozzle diaphragm 4*a*2. A plurality of second stage turbine nozzles 4*b*2 are arranged in the circumferential direction on the second stage nozzle diaphragm 4*a*2. The second stage turbine nozzles 4*b*2 are secured to the nozzle box 5, having the second stage nozzle diaphragm 4*a*2 therebetween.

In other words, the nozzle box 5 holds at least two stages of the nozzle diaphragms 4*a*1, 4*a*2, 4*a*3, . . . in this embodiment.

Thus, the steam led from the steam inlet pipe 7 into the nozzle box 5 is then led to the steam passage 8 from the outlet section of the nozzle box 5. The steam led to the steam passage 8 expands as it passes through between the turbine nozzles 4*b*1, 4*b*2, 4*b*3, . . . and the moving blades 3*b*1, 3*b*2, 3*b*3, . . . and converts its thermal energy into kinetic energy so as to drive the moving blade stages 3*a*1, 3*a*2, 3*a*3, . . . and the turbine rotor 3.

With this arrangement, the pressure in a space 10 between the turbine rotor 3 and the inner casing 2*b*, where the nozzle box 5 is arranged, (e.g. a space 10 around the nozzle box 5) is substantially equal to the pressure of the steam passage 8 at the downstream side of the second moving blade stage 3*a*2 because the outer peripheral side member of the nozzle box 5 extends to the second stage nozzle diaphragm 4*a*2.

Therefore, according to this embodiment, the pressure in the space 10 around the nozzle box 5 can be reduced, when compared to the conventional steam turbine having a nozzle box 5 provided only with the first stage nozzle diaphragm 4*a*1 as shown in FIG. 5.

As a result, the force acting on the casing 2, particularly the inner casing 2*b*, can be reduced. Thus, the steam turbine 1 may be made light weight and the material cost of the steam turbine 1 can be reduced.

The second stage nozzle diaphragm 4*a*2 is provided separately with the nozzle box 5 in this embodiment. The nozzle diaphragm 4*a*2 may alternatively be provided integrally with the nozzle box 5 like the first stage nozzle diaphragm 4*a*1. In this case, the outer peripheral member of the nozzle box 5 extending downstream side and the outer ring of the nozzle diaphragm 4*a*2 are structurally integrated with each other.

In this embodiment, the inner casing 2*b*, as a stationary section, may be rigidly secured to the nozzle box 5 by a bulkhead 9 as shown in FIG. 1. More specifically, the bulkhead 9 is arranged along the entire periphery of the nozzle box 5 in the circumferential direction, as a sealing that divides the space around the nozzle box 5, which is formed between the turbine rotor 3 and the inner casing 2*b*, into two spaces including an inner space 10*a* and an outer space 10*b*. The inner space 10*a* is located inside relative to the steam passage 8 and the outer space 10*b* is located outside relative to the steam passage 8. In other words, the inner space 10*a* means a space including an inner peripheral side (inner side) of the nozzle box 5, and the outer space 10*b* means a space including at least an outer peripheral side (outer side) of the nozzle box. The outer peripheral side of the nozzle box 5 includes outer peripheral side of the steam passage 8. With this arrangement, the flow of steam between the inner space 10*a* and the outer space 10*b* can be blocked by the bulkhead 9 that is a sealing arranged between the nozzle box 5 and the stationary section other than the nozzle box 5. Further advantages with the bulkhead 9 are described below.

As described above, the anti-leakage steam seal 11 is arranged between the first stage nozzle diaphragm 4*a*1 (e.g. the outlet section of the nozzle box 5) and the first moving blade stage 3*a*1 to reduce leakage of steam from steam passage 8.

However, when the difference between the pressure in the steam passage 8 at the outlet section of the first stage nozzle diaphragm 4*a*1 and the pressure in the space 10 around the nozzle box 5, which is the pressure in the steam passage 8 at the downstream of the second moving blade stage 3*a*2 in FIG. 1, is large, the steam flowing out from the first stage nozzle diaphragm 4*a*1 arranged at the nozzle box 5 may bypasses to the downstream side via the space 10 around the nozzle box 5, regardless of the effect of the anti-leakage steam seal 11.

The steam bypassing the space 10 around the nozzle box 5 cannot be efficiently utilize in the steam turbine 1 because it is leaked from the steam passage 8 and bypasses to the downstream side. In other words, as the rate of steam leaks out through the anti-leakage steam seal 11 rises, the efficiency of the steam turbine 1 decreases. This problem becomes significant in a turbine having a large degree of reaction where the pressure difference between the outlet of the first stage turbine nozzles 4*b*1 and the outlet of the first moving blade stage 3*a*1 is large.

However, in this embodiment as shown in FIG. 1, the bulkhead 9, as the sealing, is arranged around the nozzle box 5 to divide the space 10 around the nozzle box 5 into the inner space 10*a* and the outer space 10*b*. The steam flow between those spaces 10*a* and 10*b*, which include a bypass flow from an outlet portion of the first stage nozzle diaphragm 4*a*1 to an outlet portion of the moving blade stage 3*a*1 via the space 10 around the nozzle box 5, can be prevented.

Thus, this embodiment is additionally provided with a bulkhead 9, and the space 10 around the nozzle box 5 is divided into the inner space 10*a* and the outer space 10*b* relative to the steam passage 8. Therefore, most of the steam flowing out from the first stage nozzle diaphragm 4*a*1 arranged at the outlet section of the nozzle box 5 can be led to the first moving blade stage 3*a*1 along the steam passage 8. As a result, the thermal energy of the steam flowing out from the first stage nozzle diaphragm 4*a*1 can be efficiently converted into kinetic energy to improve the efficiency of the steam turbine 1.

The bulkhead 9, which is a sealing, is integrally arranged with the nozzle box 5 in this embodiment. Alternatively, it may be integrally arranged with the inner casing 2*b* between the nozzle box 5 and some other stationary section of the steam turbine 1. Still alternatively, it may be arranged separately with the nozzle box 5 and the inner casing 2*b* as long as it is arranged between the nozzle box 5 and some other stationary section of the steam turbine 1 and can prevent the flow of steam between the inner space 10*a* and the outer space 10*b*.

Figure 2:
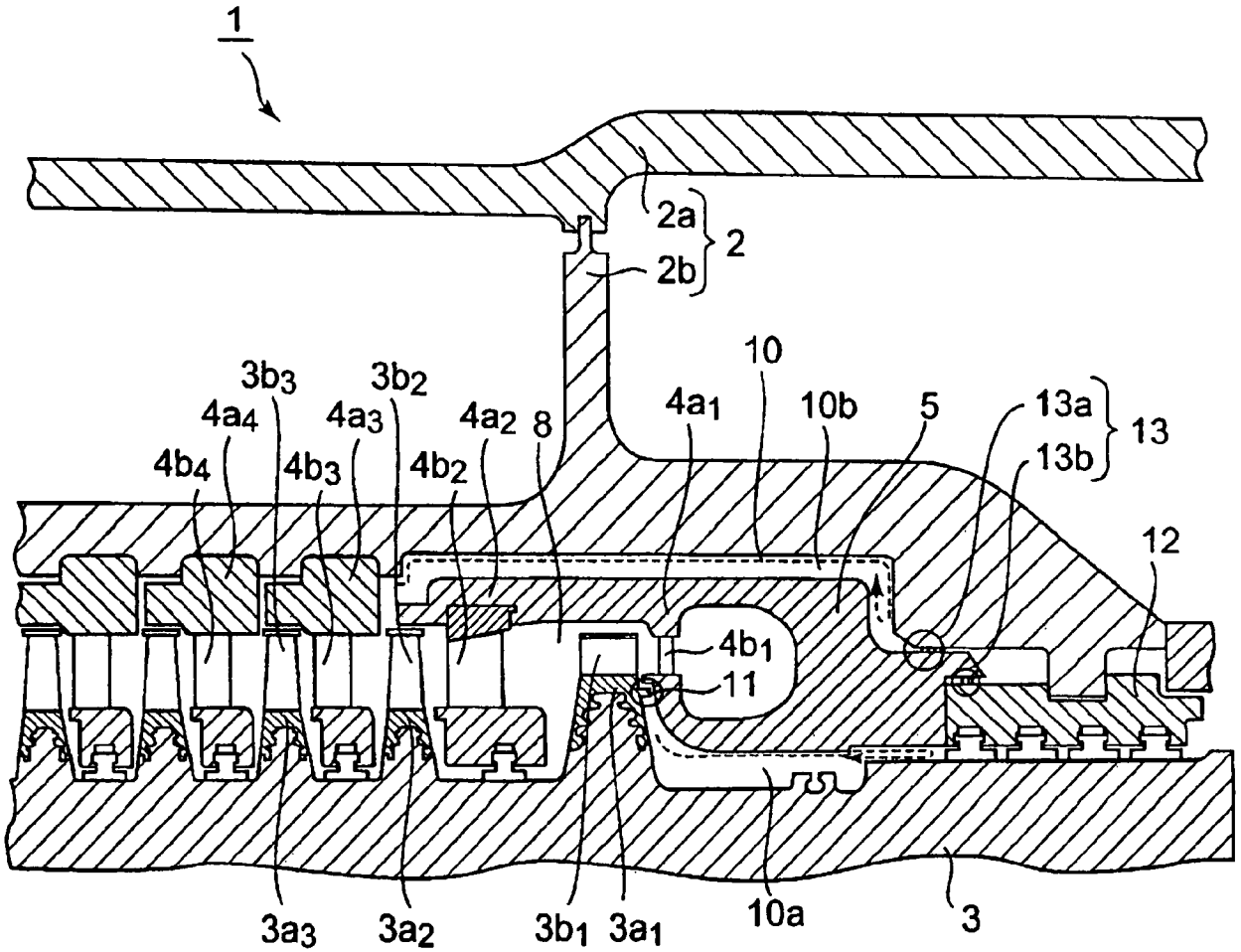
FIG. 2 is a schematic axial cross-sectional view of a modified embodiment of the first embodiment taken along a plane inclined by 45° from the vertical direction.
Figure 3:
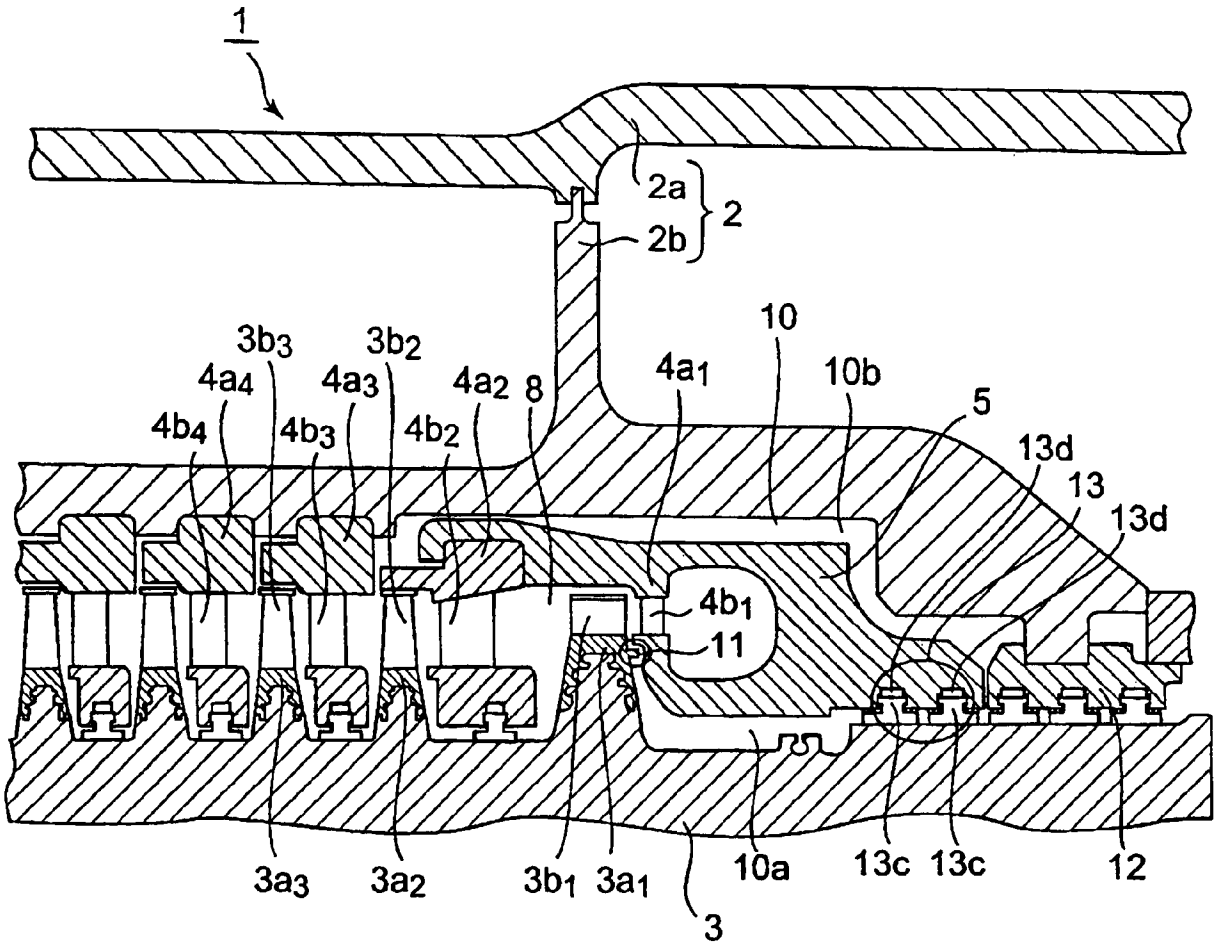
FIG. 3 is a schematic axial cross-sectional view of another modified embodiment of the first embodiment taken along a plane inclined by 45° from the vertical direction.
Figure 4:
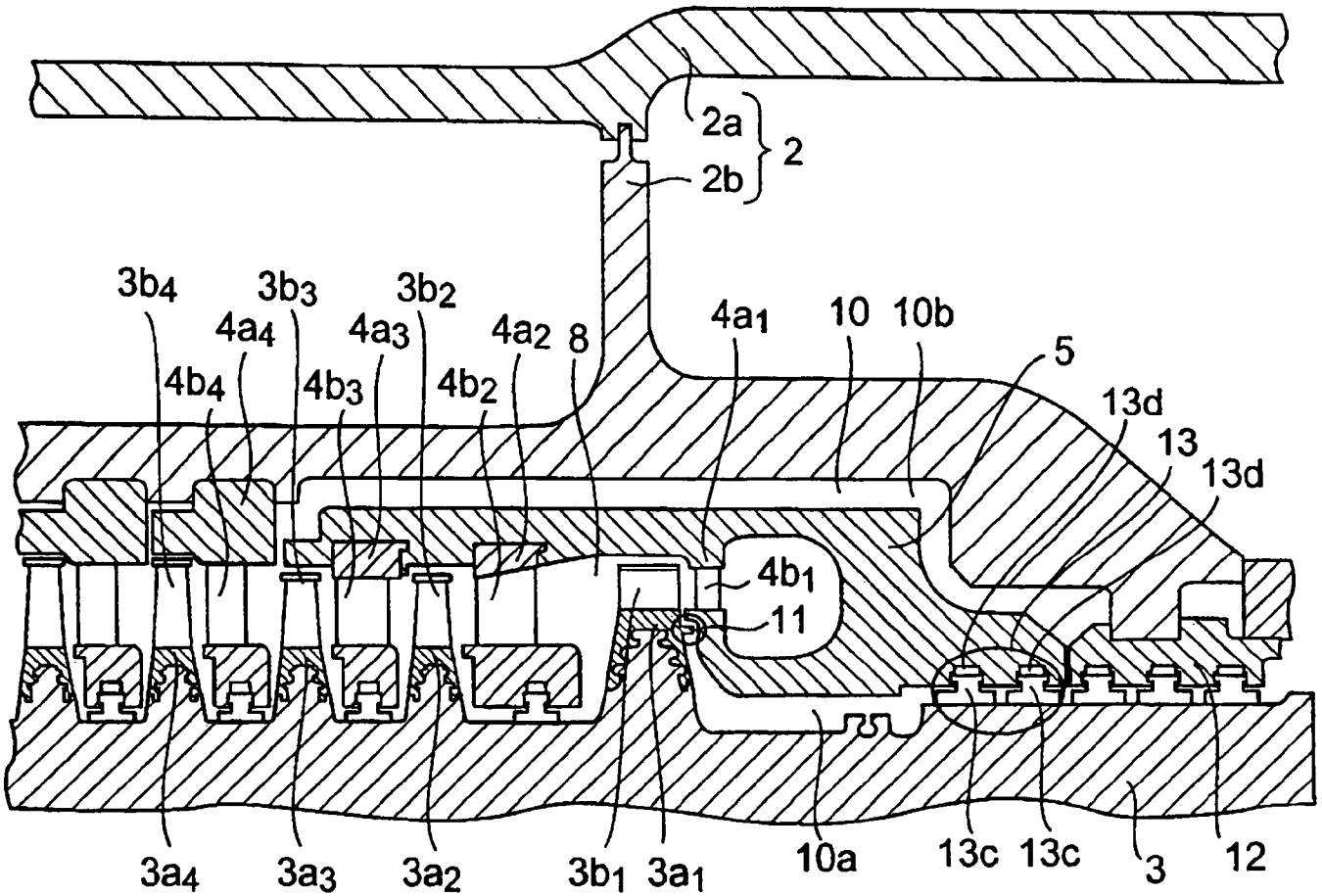
FIG. 4 is a schematic axial cross-sectional view of yet another modified embodiment of the first embodiment taken along a plane inclined by 45° from the vertical direction.

FIGS. 2 through 4 show modified embodiments of this embodiment. Note that FIGS. 2 through 4 are schematic axial cross-sectional views of the modified embodiments of this embodiment taken along a plane inclined by 45° from the vertical direction. Note that the components of these modified embodiments that are same as those of the steam turbine 1 shown in FIG. 1 are denoted respectively by the same reference symbols and will not be described in greater detail.

In each of the steam turbines 1 of the modified embodiments of this embodiment shown in FIGS. 2 and 3, the space 10 formed around the nozzle box 5 between the turbine rotor 3 and the inner casing 2*b* is divided by a sealing other than a bulkhead 9 shown in FIG. 1 into an inner space 10*a* located inside relative to the steam passage 8 and an outer space 10*b* located outside relative to the steam passage 8. Otherwise, these modified embodiments are the same as the first embodiment shown in FIG. 1.

In the embodiment described in FIG. 1, the bulkhead 9 is provided as a sealing dividing the space 10 into the inner space 10*a* and the outer space 10*b*. In these modified embodiments shown in FIGS. 2 and 3, the bulkhead 9 is replaced by a nozzle box sealing device 13 as a sealing. In other words, in each of these modified embodiments, the space formed around the nozzle box 5 between the turbine rotor 3 and the inner casing 2*b* is divided by a nozzle box sealing device 13 into the inner space 10*a* located inside relative to the steam passage 8 and the outer space 10*b* located outside relative to the steam passage 8. The inner space 10*a* means a space including an inner peripheral side (inner side) of the nozzle box 5, and the outer space 10*b* means a space including at least an outer peripheral side (outer side) of the nozzle box. The outer peripheral side of the nozzle box 5 includes outer peripheral side of the steam passage 8.

Particularly, in the modified embodiment shown in FIG. 2, the nozzle box sealing device 13 comprises a casing side sealing device 13*a* which seals a gap between the nozzle box 5 and the inner casing 2*b*, and a rotor side sealing device 13*b* which seals a gap between the nozzle box 5 and the main body of the shaft sealing device 12. Therefore, steam do not flow from the inner space 10*a* to the outer space 10*b* and vice versa. This arrangement provides advantages similar to those of the first embodiment of FIG. 1.

In the other modified embodiment shown in FIG. 3, the nozzle box sealing device 13 comprises a packing head 13*c*, which seals a gap between the nozzle box 5 and the turbine rotor 3, and a groove section 13*d* circumferentially provided on an outer surface of the nozzle box 5 facing to the turbine rotor 3. The packing head 13*c* comprises a plurality of segments arranged in the circumferential direction inserted into the groove section 13*d* of the nozzle box 5 for engagement. Thus, as a whole, the gap between the nozzle box 5 and the turbine rotor 3 is sealed along the entire periphery of the turbine rotor 3.

With this arrangement, the packing head 13*c* can be readily replaced with new ones when steam leaks due to degradation with time of the packing head 13*c*. Thus, the maintainability of the packing head 13*c* is improved. The modified embodiment of FIG. 3 has two nozzle box sealing devices 13, each having a packing head 13*c* and a groove section 13*d*, that are arranged in series in the axial direction. However, the number of nozzle box sealing devices may be made one or more than two appropriately depending on the required pressure difference between the inner space 10*a* and the outer space 10*b*.

The other modified embodiment shown in FIG. 4 further modifies the modified embodiment of FIG. 3. In the first embodiments including modified embodiments shown in FIGS. 1 through 3, the nozzle box 5 holds the first stage turbine nozzles 4*b*1 and the second stage turbine nozzles 4*b*2. In this further modified embodiment shown in FIG. 4, the nozzle box 5 further holds the third stage turbine nozzles 4*b*3.

More specifically, as shown in FIG. 4, the outer peripheral side member of the nozzle box 5 of the steam turbine extends to the downstream side in the axial direction. Two hook sections are provided at the extended portion, and the second stage nozzle diaphragm 4*a*2 and the third stage nozzle diaphragm 4*a*3 are engaged respectively with the two hook sections. A plurality of second stage turbine nozzles 4*b*2 and a plurality of third stage turbine nozzles 4*b*3 are circumferentially provided respectively with the second stage nozzle diaphragm 4*a*2 and the third stage nozzle diaphragm 4*a*3. Thus, in this modified embodiment, the second stage turbine nozzles 4*b*2 and the third stage turbine nozzles 4*b*3 are secured to the nozzle box 5 respectively, having the second stage nozzle diaphragm 4*a*2 and the third stage nozzle diaphragm 4*a*3 therebetween. Otherwise, the configuration of this modified embodiment is the same as that of the modified embodiment of the first embodiment shown in FIG. 3.

With this arrangement, the pressure of the outer space 10*b* of the space around the nozzle box 5 is substantially equal to the pressure of the steam passage 8 at the outlet of the third moving blade stage 3*a*3. As a result, the pressure of the outer space 10*b* can be further reduced, so that the wall thickness of the inner casing 2*b* can be reduced accordingly.

In this modified embodiment shown in FIG. 7, the second and third stage nozzle diaphragms 4*a*2, 4*a*3 are arranged separately with the nozzle box 5, and the second stage and third stage turbine nozzles 4*b*2, 4*b*3 are held by the nozzle box 5 respectively by having nozzle diaphragms 4*a*2, 4*a*3 therebetween. However, the arrangement is not limited to those, and the second stage and third stage nozzle diaphragms 4*a*2, 4*a*3 may be integrally formed with the outer peripheral member of the nozzle box 5 extended to the downstream side in the axial direction.

Only the first through third stage turbine nozzles 4*b*1, 4*b*2, 4*b*3 are held by the nozzle box 5 in the modified embodiment shown in FIG. 4. Alternatively, the fourth and the subsequent turbine nozzles 4*b*4, . . . may also be held by the nozzle box 5.

The nozzle box sealing device 13 including the packing head 13*c* and the groove section 13*d* is provided as a sealing for dividing the space around the nozzle box 5 into the inner space 10*a* and the outer space 10*b* in the modified embodiment of FIG. 4. However, alternatively, the nozzle box sealing device 13 may two members including a casing side sealing device 13*a*, which seals a gap between the nozzle box 5 and the inner casing 2*b* and a rotor side sealing device 13*b*, which seals a gap between the nozzle box 5 and the main body of the shaft sealing device 12 as shown in FIG. 2. Alternatively, the nozzle box sealing device 13 may be replaced by a bulkhead 9 as shown in FIG. 1.

What is claimed is:

1. A steam turbine comprising:

a stationary section that includes a casing;

a turbine rotor that includes a plurality of moving blade stages arranged in an axial direction, each of the moving blade stages being provided with a plurality of moving blades arranged in a circumferential direction, and rotatably provided in the casing;

a plurality of nozzle diaphragms, wherein each of the nozzle diaphragms having a plurality of turbine nozzles arranged in the circumferential direction, provided substantially coaxially with the turbine rotor by being secured to the stationary section;

a steam passage, wherein a portion of the moving blades of the moving blade stages and a portion of the turbine nozzles of the nozzle diaphragms constitute the steam passage;

a nozzle box supported on the stationary section, wherein the nozzle box is arranged at an upstream side of the moving blade stages substantially coaxially with the turbine rotor so as to lead steam flowing toward the moving blades, wherein the nozzle box holds at least two stages of the nozzle diaphragms; and a sealing that divides a space between the turbine rotor and the casing into a first space provided at an inner side of the nozzle box and a second space provided at an outer side of the nozzle box.

2. The steam turbine according to claim 1, wherein at least one of the nozzle diaphragms it holds is provided integrally with the nozzle box.

* * * * *